US010056023B2

(12) United States Patent
Kang et al.

(10) Patent No.: US 10,056,023 B2
(45) Date of Patent: Aug. 21, 2018

(54) DISPLAY DEVICE AND METHOD OF REPAIRING THE SAME

(71) Applicant: Samsung Display Co., Ltd., Yongin-si, Gyeonggi-do (KR)

(72) Inventors: Seong Yeun Kang, Asan-si (KR); Kyong Tae Park, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 160 days.

(21) Appl. No.: 15/136,606

(22) Filed: Apr. 22, 2016

(65) Prior Publication Data

US 2016/0335950 A1 Nov. 17, 2016

(30) Foreign Application Priority Data

May 13, 2015 (KR) ..... 10-2015-0066760

(51) Int. Cl.
*G09G 3/20* (2006.01)
*G09G 3/3233* (2016.01)
*G09G 3/3275* (2016.01)

(52) U.S. Cl.
CPC ..... *G09G 3/2085* (2013.01); *G09G 3/3233* (2013.01); *G09G 3/3275* (2013.01); (Continued)

(58) Field of Classification Search
CPC .. G09G 3/2085; G09G 3/3233; G09G 3/3275; G09G 2300/0413; G09G 2300/08; (Continued)

(56) References Cited

U.S. PATENT DOCUMENTS

2005/0168491 A1* 8/2005 Takahara ..... G09G 3/006 345/690
2012/0092579 A1* 4/2012 Liu ..... G09G 3/20 349/55
2015/0102312 A1 4/2015 Lee et al.

FOREIGN PATENT DOCUMENTS

EP 2 998 953 A2 3/2016
JP 2007-316511 A 12/2007
(Continued)

OTHER PUBLICATIONS

Extended European Search Report dated Aug. 5, 2016 for European Patent Application No. EP 16 169 639.8, which shares priority of Korean Patent Application No. KR 10-2015-0066760 with subject U.S. Appl. No. 15/136,606.

*Primary Examiner* — Sahlu Okebato
(74) *Attorney, Agent, or Firm* — Knobbe Martens Olson & Bear LLP

(57) ABSTRACT

A display device and a method of repairing the same are disclosed. In one aspect, the display device includes an OLED, a repair line electrically connected to a first dummy pixel and a second dummy pixel, and a repair modulation circuit electrically connected to the first and second dummy pixels. The first dummy pixel includes a first dummy pixel driving circuit configured to output a driving current corresponding to a data voltage of a selected pixel of the OLED to the repair line, when the selected pixel becomes defective, based on a first light emission control signal. The repair modulation circuit includes a capacitor configured to be initialized before the driving current is output from the first dummy pixel driving circuit. The capacitor of the repair modulation circuit is configured to be charged with the driving current when the driving current is output from the first dummy pixel driving circuit.

19 Claims, 11 Drawing Sheets

(52) U.S. Cl.
CPC . *G09G 2300/0413* (2013.01); *G09G 2300/08* (2013.01); *G09G 2300/0861* (2013.01); *G09G 2310/0251* (2013.01); *G09G 2310/0262* (2013.01); *G09G 2310/0289* (2013.01); *G09G 2330/08* (2013.01); *G09G 2330/10* (2013.01)

(58) Field of Classification Search
CPC ... G09G 2300/0861; G09G 2310/0251; G09G 2310/0262; G09G 2310/0289; G09G 2330/08; G09G 2330/10
See application file for complete search history.

(56) References Cited

FOREIGN PATENT DOCUMENTS

| | | | |
|---|---|---|---|
| KR | 10-2010-0077434 | A | 7/2010 |
| KR | 10-2014-0051677 | A | 5/2014 |
| KR | 10-2016-0032756 | A | 3/2016 |

* cited by examiner

DISPLAY DEVICE AND METHOD OF REPAIRING THE SAME

INCORPORATION BY REFERENCE TO ANY PRIORITY APPLICATIONS

This application claims priority to and the benefit of Korean Patent Application No. 10-2015-0066760 filed in the Korean Intellectual Property Office on May 13, 2015, the entire contents of which are incorporated herein by reference.

BACKGROUND

Field

The described technology generally relates to a display device and a method of repairing the same.

Description of the Related Technology

A display device (such as an organic light-emitting diode (OLED) display) does not require a separate light source and thus has favorable characteristics such as low power consumption and excellent refresh rate, high viewing angle, and high contrast ratio.

A display device includes a matrix of pixels such as red, blue, green, and white pixels, and can express a full color by combining the pixels. Each pixel includes light emitting element (such as an organic light-emitting diode (OLED)) and thin film transistors for driving the OLED.

Each OLED includes a pixel electrode, a common electrode, and an interposed emission layer. One of the pixel and common electrodes is an anode, and the other is a cathode. An electron injected from the cathode and a hole injected from the anode are combined in the emission layer to form an exciton, and the exciton emits light while discharging energy. The common electrode is formed throughout the pixels to transfer a predetermined common voltage.

In the display device, since a pixel is complicated and a manufacturing process is difficult, in the manufacturing process, a defective pixel can be generated. Accordingly, in order to enhance yield, a repair process which can use the defective pixel generated in the manufacturing process as a normal pixel is required.

The above information disclosed in this Background section is only for enhancement of understanding of the background of the described technology and therefore it can contain information that does not constitute the prior art that is already known in this country to a person of ordinary skill in the art.

SUMMARY OF CERTAIN INVENTIVE ASPECTS

One inventive aspect relates to a display device and a method of repairing the same. Another aspect is repairing a defective pixel to be a normal pixel.

Another aspect is a display device including: an OLED of a defective pixel, a repair line connected to a first dummy pixel and a second dummy pixel, and a repair modulation circuit connected to the first dummy pixel and the second dummy pixel, in which the first dummy pixel includes a first dummy pixel driving circuit outputting a driving current corresponding to the data voltage of the defective pixel to the repair line in response to a first light emission control signal, and the repair modulation circuit includes a capacitor which is initialized before the driving current is output from the first dummy pixel driving circuit, charged by the driving current when the driving current is from the first dummy pixel driving circuit, and charge-shared with a parasitic capacitance component of the repair line.

The first dummy pixel, the second dummy pixel, and the repair modulation circuit can be connected to the sub repair line, and the first dummy pixel and the second dummy pixel can share the repair modulation circuit through the sub repair line.

The second dummy pixel can include a second dummy pixel driving circuit applying a driving current corresponding to a first data voltage to the repair line in response to a second light emission control signal, and the first data voltage can be a black gray data voltage.

The repair modulation circuit can further include a transistor connected between the capacitor and the repair line and turned on or off according to the first light emission control signal.

The repair modulation circuit can further include an initialization transistor connected between the capacitor and a voltage line supplying an initialization voltage and turned on or off according to a first initialization signal.

In the repair modulation circuit, before the driving current is output to the repair line, the voltage of the first initialization signal can be changed from a first level to a second level to turn on the initialization transistor.

After the initialization transistor is turned on, the first dummy pixel driving circuit can output the driving current to the repair line.

The display device can further include a third dummy pixel connected to the repair line, in which the third dummy pixel can include a third dummy pixel driving circuit applying a driving current corresponding to a second data voltage to the repair line in response to a third light emission control signal, and the second data voltage can be a black gray data voltage.

Another aspect is a method of repairing a display device including an OLED of a defective pixel, a repair line connected to a first dummy pixel and a second dummy pixel, and a repair modulation circuit connected to the first dummy pixel and the second dummy pixel, in which the first dummy pixel includes a first dummy pixel driving circuit and the repair modulation circuit includes a capacitor, the method including: connecting the repair line to an OLED of a defective pixel; initializing the capacitor; outputting a driving current corresponding to a data voltage of the defective pixel to the repair line in the first dummy pixel; charging the capacitor by the driving current when the driving current is output in the first dummy pixel driving circuit; and charge-sharing with a parasitic capacitance component of the charged capacitor and the repair line.

The method can further include: connecting the first dummy pixel, the second dummy pixel, and the repair modulation circuit to a sub repair line; and sharing the repair modulation circuit by the first dummy pixel and the second dummy pixel.

The method can further include: applying a driving current corresponding to a first data voltage to the repair line in response to a second light emission control signal, in which the second dummy pixel can include a second dummy pixel driving circuit, and the first data voltage can be a black gray data voltage.

The repair modulation circuit can further include a transistor connected between the capacitor and the repair line and turned on or off according to the first light emission control signal.

The repair modulation circuit can further include an initialization transistor connected between the capacitor and a voltage line supplying an initialization voltage and turned on or off according to a first initialization signal.

The initializing of the capacitor can include changing the voltage of the first initialization signal from a first level to a second level to turn on the initialization transistor.

The outputting of the driving current to the repair line can include outputting the driving current to the repair line by the first dummy pixel driving circuit before the initialization transistor is turned on.

The method can further include applying a driving current corresponding to a second data voltage to the repair line in response to a third light emission control signal, in which a third dummy pixel connected to the repair line and the third dummy pixel can include a third dummy pixel driving circuit, and the second data voltage can be a black gray data voltage.

Another aspect is a display device, comprising: an organic light-emitting diode (OLED); a repair line electrically connected to a first dummy pixel and a second dummy pixel; and a repair modulation circuit electrically connected to the first and second dummy pixels, wherein the first dummy pixel includes a first dummy pixel driving circuit configured to output a driving current corresponding to a data voltage of a selected pixel of the OLED to the repair line, when the selected pixel becomes defective, based on a first light emission control signal, wherein the repair modulation circuit includes a capacitor configured to be initialized before the driving current is output from the first dummy pixel driving circuit, wherein the capacitor of the repair modulation circuit is configured to be charged with the driving current when the driving current is output from the first dummy pixel driving circuit, and wherein the capacitor is further configured to share the charged current with a parasitic capacitance of the repair line.

In the above display device, the first dummy pixel, the second dummy pixel, and the repair modulation circuit are electrically connected to a sub repair line, wherein the first and second dummy pixels share the repair modulation circuit via the sub repair line.

In the above display device, the second dummy pixel includes a second dummy pixel driving circuit configured to apply a driving current corresponding to a first data voltage to the repair line based on a second light emission control signal, wherein the first data voltage includes a black gray data voltage.

In the above display device, the repair modulation circuit further includes a transistor electrically connected between the capacitor and the repair line and configured to be turned on or off based on the first light emission control signal.

In the above display device, the repair modulation circuit further includes an initialization transistor electrically connected between the capacitor and a voltage line configured to provide an initialization voltage, wherein the initialization transistor is configured to be turned on or off based on a first initialization signal.

In the above display device, a voltage level of the first initialization signal is configured to be changed from a first level to a second level to turn on the initialization transistor before the driving current is output to the repair line.

In the above display device, the first dummy pixel driving circuit is configured to provide the driving current to the repair line after the initialization transistor is turned on.

The above display device further comprises a third dummy pixel electrically connected to the repair line and including a third dummy pixel driving circuit configured to apply a driving current corresponding to a second data voltage to the repair line based on a third light emission control signal, wherein the second data voltage includes a black gray data voltage.

Another aspect is a method of repairing a display device including a repair line electrically connected to a first dummy pixel and a second dummy pixel, and a repair modulation circuit electrically connected to the first and second dummy pixels, the method comprising: electrically connecting the repair line to an organic light-emitting diode (OLED) of a defective pixel in the display device, wherein the first dummy pixel includes a first dummy pixel driving circuit, and wherein the repair modulation circuit includes a capacitor; initializing the capacitor; providing a driving current corresponding to a data voltage of the defective pixel to the repair line in the first dummy pixel; charging the capacitor with the driving current when the driving current is output from the first dummy pixel driving circuit; and sharing the charged current of the capacitor with a parasitic capacitance of the charged capacitor and the repair line.

The above method further comprises: electrically connecting the first dummy pixel, the second dummy pixel, and the repair modulation circuit to a sub repair line; and sharing the repair modulation circuit between the first and second dummy pixels.

In the above method, the second dummy pixel includes a second dummy pixel driving circuit, wherein the method further comprises applying a driving current corresponding to a first data voltage to the repair line based on a second light emission control signal, and wherein the first data voltage includes a black gray data voltage.

In the above method, the repair modulation circuit further includes a transistor electrically connected between the capacitor and the repair line and configured to be turned on or off based on the first light emission control signal.

In the above method, the repair modulation circuit further includes an initialization transistor electrically connected between the capacitor and a voltage line configured to provide an initialization voltage, wherein the initialization transistor is configured to be turned on or off based on a first initialization signal.

In the above method, the initializing of the capacitor includes changing the voltage of the first initialization signal from a first level to a second level so as to turn on the initialization transistor.

In the above method, the providing of the driving current to the repair line includes providing the driving current to the repair line via the first dummy pixel driving circuit before the initialization transistor is turned on.

In the above method, the display device further includes a third dummy pixel electrically connected to the repair line and including a third dummy pixel driving circuit, wherein the method further comprises applying a driving current corresponding to a second data voltage to the repair line based on a third light emission control signal, and wherein the second data voltage includes a black gray data voltage.

Another aspect is a display device, comprising: a display panel including a display area and a non-display area surrounding the display area; a plurality of display pixels formed in the display area and each including an organic light-emitting diode; a plurality of dummy pixels formed in the non-display area and including a first dummy pixel and a second dummy pixel; and a repair modulation circuit electrically connected to the first and second dummy pixels and a selected display pixel, wherein the first dummy pixel includes a first dummy pixel driving circuit configured to provide a driving current corresponding to a data voltage of the selected display pixel to the repair line, when the selected display pixel becomes defective, based on a first light emission control signal, wherein the repair modulation circuit includes an initialization capacitor configured to be initialized before the driving current is provided from the first dummy pixel driving circuit, wherein the initialization capacitor of the repair modulation circuit is configured to be charged with the driving current when the driving current is provided from the first dummy pixel driving circuit, and wherein the initialization capacitor is further configured to share the charged current with a parasitic capacitance of the repair line when the selected display pixel is defective.

In the above display device, the parasitic capacitance includes a first parasitic capacitor formed between the repair line and an anode electrode of the OLED of the selected pixel.

In the above display device, the parasitic capacitance further includes a second parasitic capacitor formed between the repair line and a first initialization scan line connected to the selected pixel.

In the above display device, the parasitic capacitance further includes a third parasitic capacitor formed between the repair line and a second initialization scan line connected to the repair modulation circuit.

The above display device further comprises a driving transistor configured to output a current, wherein the current is configured to compensate for a voltage lost by the charge-shared initialization and first to third capacitors.

According to at least one of the disclosed embodiments, it is possible to repair a defective pixel.

DETAILED DESCRIPTION OF CERTAIN INVENTIVE EMBODIMENTS

Figure 1:
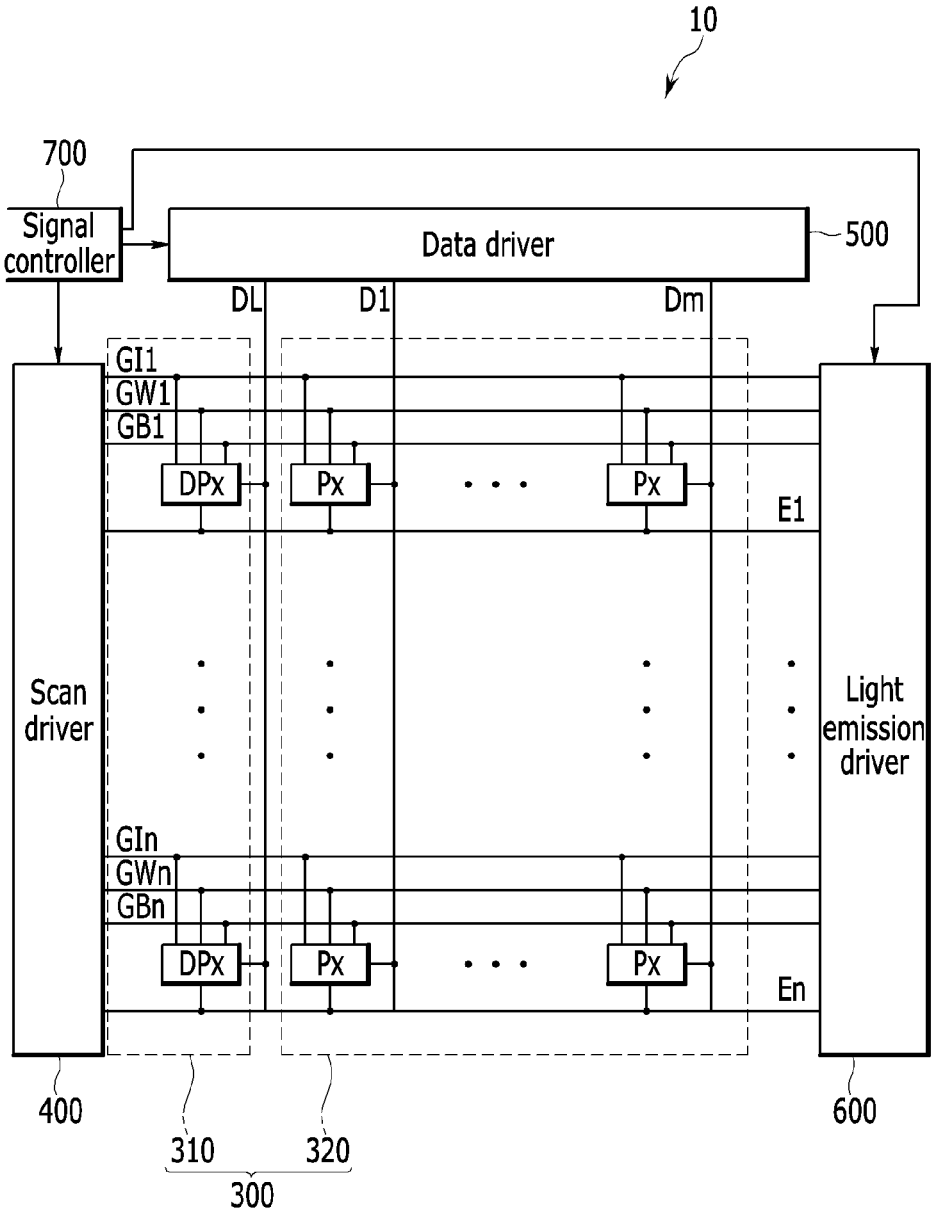
FIG. 1 is a block diagram of a display device according to an exemplary embodiment.

Hereinafter, exemplary embodiments will be described in more detail with reference to the accompanying drawings. Like reference numerals refer to like elements for easy overall understanding and a duplicated description of like elements will be omitted. Further, "module" and "unit" which are suffixes for the components used in the specification are granted or mixed by considering only easiness in preparing the specification and do not have meanings or roles distinguished from each other in themselves. Further, in describing the described technology, when it is determined that the detailed description of the publicly known art related to the described technology can obscure the gist of the described technology, the detailed description thereof will be omitted. Further, the accompanying drawings are only for easily understanding the exemplary embodiment disclosed in the specification and the technical spirit disclosed in the specification is not limited by the accompanying drawings and it should appreciated that the accompanying drawings include all changes, equivalents, or substitutions included in the spirit and the technical scope of the described technology.

Terms including an ordinary number, such as first and second, are used for describing various constituent elements, but the constituent elements are not limited by the terms. The above terms are used only to discriminate one component from the other component.

It should be understood that, when it is described that an element is "coupled" or "connected" to another element, the element can be "directly coupled" or "directly connected" to the another element or "coupled" or "connected" to the another element through a third element. In contrast, it should be understood that, when it is described that an element is "directly coupled" or "directly connected" to another element, it is understood that no element is not present between the element and the another element.

Singular expressions used herein include plurals expressions unless they have definitely opposite meanings.

In this specification, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations, in advance. In this disclosure, the term "substantially" includes the meanings of completely, almost completely or to any significant degree under some applications and in accordance with those skilled in the art. Moreover, "formed on" can also mean "formed over."

Figure 2:
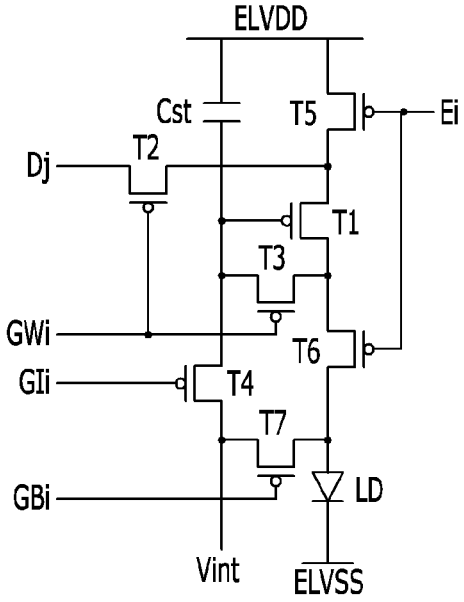
FIG. 2 is an equivalent circuit diagram exemplifying a pixel of FIG. 1.

FIG. 1 is a block diagram of a display device 10 according to an exemplary embodiment. FIG. 2 is an equivalent circuit diagram exemplifying a pixel of FIG. 1.

Referring to FIG. 1, the display device 10 according to an exemplary embodiment includes a display panel 300, a scan driver 400, a data driver 500, a light emission driver 600, and a signal controller 700. Depending on embodiments, certain elements may be removed from or additional elements may be added to the display device 10 illustrated in FIG. 1. Furthermore, two or more elements may be combined into a single element, or a single element may be realized as multiple elements. This also applies to the remaining disclosed embodiments.

The display panel 300 includes a dummy area 310 and a display area 320. The dummy area 310 includes a plurality of signal lines GI1-GWn, GW1-GWn, and GB1-GBn and a dummy signal line DL, and a plurality of dummy pixels DPx connected thereto. The display area 320 includes a plurality of pixels PX which is connected to the plurality of signal lines GI1-GWn, GW1-GWn, GB1-GBn, E1-En, and D1-Dm and arranged substantially in a matrix form.

The signal lines GI1-GWn, GW1-GWn, GB1-GBn, E1-En, and D1-Dm include a plurality of scan lines GI1-GIn, GW1-GWn, and GB1-GBn transferring scan signals, a plurality of data lines D1-Dm transferring data signals according to an input image signal, and a plurality of light emission scan lines E1-En transferring light emission scan signals (or light emission control signals) for light emission control. The scan lines GI1-GIn, GW1-GWn, and GB1-GB extend substantially in a row direction and are substantially parallel with each other, the data lines D1-Dm extend substantially in a column direction and are substantially parallel with each other, and the light emission scan lines E1-En extend substantially in a row direction and are substantially parallel with each other. The pixels PX is formed in areas defined by the scan lines G1-Gn and the data lines D1-Dm, respectively.

The dummy signal line DL transfers a data signal corresponding to a pixel to be repaired and extends substantially in a column direction. The dummy pixels DPx is connected to the dummy signal line DL and connected even to the corresponding scan line and the corresponding light emission scan line among the plurality of scan lines GI1-GIn, GW1-GWn, and GB1-GB and the light emission scan lines E1-En.

The scan driver 400 is connected to the scan lines GI1-GIn, GW1-GWn, and GB1-GB of the display panel 300 and applies a scan signal configured by combining a voltage turning on a switching transistor of the pixel PX and the dummy pixel DPx and a low voltage turning off the switching transistor to the scan lines GI1-GIn, GW1-GWn, and GB1-GB.

The data driver 500 is connected to the data lines D1-Dm of the display panel 300 to apply a data signal to the data lines D1-Dm. The data driver 500 can select the data signal from the entire gray voltages related with luminance of the pixel PX and can also generate a desired data signal by dividing a predetermined number of gray voltages.

The light emission driver 600 is connected to the light emission scan lines E1-En of the display panel 300 and applies a light emission scan signal configured by combining a voltage turning on a light emission transistor of the pixel PX and the dummy pixel DPx and a low voltage turning off the light emission transistor to the light emission scan lines E1-En.

The signal controller 700 controls the scan driver 400, the data driver 500, and the light emission driver 600.

Each of the drivers 400, 500, 600, and 700 can be directly mounted on the display unit 300 in at least one IC chip form, mounted on a flexible printed circuit film (not illustrated) to be attached to the display unit 300 in a tape carrier package (TCP) form, or mounted on a separate printed circuit board (not illustrated).

In some embodiments, the drivers 400, 500, 600, and 700 are integrated on the display panel 300 together with the signal lines GI1-GIn, GW1-GWn, GB1-GBn, D1-Dm, and E1-En, a thin film transistor, and the like. Further, the drivers 400, 500, 600, and 700 can be integrated by a single chip, and in this case, at least one of the drivers or at least one circuit element configuring the drivers can be positioned outside the single chip.

Referring to FIG. 2, a pixel PX connected to i-th (i=1, 2, . . . , n) scan lines GIi and GWi and a j-th (j=1, 2, . . . , m) data line Dj includes an OLED LD, a driving transistor T1, a storage capacitor Cst, and a plurality of switching transistors T2, T3, T4, T5, T6, and T7. The pixel PX illustrated in FIG. 2 is an example of a pixel using a data voltage as a data signal.

The driving transistor T1 and the switching transistors T2-T7 have a control terminal and two input and output terminals. The driving transistor T1 and the switching transistors T2-T7 can be p-channel field effect transistors (FET) formed of amorphous silicon or polysilicon, and the control terminal and the two input and output terminals can be a gate, a source, and a drain, respectively. However, at least one of the driving transistor T1 and the switching transistors T2-T7 can be an n-channel FET. In this case, a connection relationship between the driving transistor T1, the switching transistors T2-T7, the capacitor Cst, and the OLED LD to be described below can be changed.

The control terminal of the switching transistor T2 is connected to the scan line GWi, a first input and output terminal is connected to the data line Dj, and a second input and output terminal is connected to the first input and output terminal of the driving transistor T1. The switching transistor T2 transfers a data voltage Vdata applied to the data line Dj in response to a scan signal at a low voltage applied to the scan line GWi.

The control terminal of the switching transistor T3 is connected to the scan line GWi, and the first input and output terminal and the second input and output terminal are connected to the control terminal and the second input and output terminal of the driving transistor T1, respectively. The switching transistor T3 diode-connects the driving transistor T1 in response to the scan signal at the low voltage applied to the scan line GWi.

The storage capacitor Cst is connected between the control terminal of the driving transistor T1 and a driving voltage line supplying a driving voltage ELVDD. When the switching transistors T2 and T3 are turned on in response to the scan signal at the low voltage applied to the scan line GWi, a voltage corresponding to the data voltage Vdata is charged through the diode-connected driving transistor T1. Even after the switching transistors T2 and T3 are turned off, the voltage is maintained.

A control terminal of the switching transistor T4 is connected to a first initialization scan line GIi, a first input and output terminal is connected to the control terminal of the driving transistor T1, and a second input and output terminal is connected to an initialization voltage line supplying an initialization voltage Vint. The switching transistor T4 is turned on in response to an initialization scan signal at a low voltage applied to the first initialization scan line GIi to initialize a voltage of a node where the control terminal of the driving transistor T1 and the capacitor Cst meet each other to the initialization voltage Vint.

The control terminals of the switching transistors T5 and T6 are connected to a light emission scan line Ei. In addition, the first input and output terminal of the switching transistor T5 is connected to the driving voltage line ELVDD, and the second input and output terminal is connected to the first input and output terminal of the driving transistor T1. The first input and output terminal of the switching transistor T6 is connected to the second input and output terminal of the driving transistor T1, and the second input and output terminal is connected to the OLED LD. The switching transistors T5 and T6 are turned on in response to a light emission scan signal at a low voltage applied to the light emission scan line Ei to form a current path between the driving voltage line ELVDD, the driving transistor T1, and the OLED LD. Accordingly, the driving transistor T1 runs an output current of which amplitude varies according to a voltage applied between the control terminal and the first input and output terminal, that is, a voltage charged in the capacitor Cst.

The OLED LD can have an anode connected to the second input and output terminal of the switching transistor T6 and a cathode connected to the common voltage ELVSS. The OLED LD emits light by varying the intensity according to the output current of the driving transistor T1 to display an image.

The OLED LD can emit light of one of the primary colors. As an example of the primary colors, three primary colors of red, green, and blue can be included, and a desired color is displayed in a spatial sum or a temporal sum of the three primary colors. In this case, some OLEDs LD can emit white light, and as a result, luminance is increased. In some embodiments, the OLEDs LD of all of the pixels PX emit white light, and some pixels PX further include color filters (not illustrated) changing the white light emitted from the OLEDs LD into any one of the primary color light.

In this case, a pixel bundle displaying a desired color can include three pixels displaying red, green, and blue, respectively, or can further include a pixel displaying white.

The control terminal of the switching transistor T7 is connected to a second initialization scan line GBi, the first input and output terminal is connected to the initialization voltage line Vint, and the second input and output terminal is connected to the second input and output terminal of the switching transistor T6, that is, an anode of the OLED LD. The switching transistor T7 is turned on in response to the initialization scan signal at the low voltage applied to the second initialization scan line GBi to initialize an anode voltage of the OLED LD to the initialization voltage Vint.

Next, driving of the display device according to the exemplary embodiment will be described with reference to FIG. 3.

Figure 3:
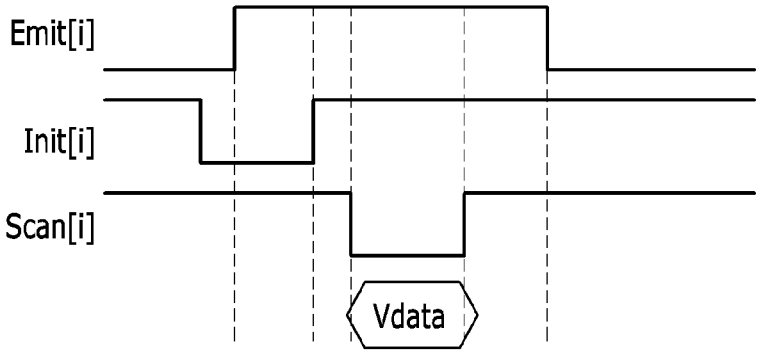
FIG. 3 is a signal timing of the pixel of FIG. 2.

FIG. 3 is a signal timing of the pixel of FIG. 2.

Referring to FIGS. 1 to 3, while a light emission scan signal Emit[i] at a high voltage Vgh is applied to the light emission scan line Ei, an initialization scan signal Init[i] at a low voltage Vgl is applied to the first initialization scan line GIi and the second initialization scan line GBi. Then, the switching transistor T4 is turned on and a node where the control terminal of the driving transistor T1 and the capacitor Cst meet each other is initialized with the initialization voltage Viint. Further, the switching transistor T7 is turned on and then a node where the anode of the OLED LD and the switching transistor T6 meet each other is initialized with the initialization voltage Vint. Accordingly, the voltage of the capacitor Cst and the voltage charged in a parasitic capacitance component (hereinafter, referred to as a parasitic capacitor) of the OLED LD can be initialized. For convenience of description, the initialization scan signal Init[i] is substantially simultaneously (or concurrently) applied to the first initialization scan line GIi and the second initialization scan line GBi, but the exemplary embodiment is not limited thereto.

Next, while the light emission scan signal Emit[i] at the high voltage Vgh is applied to the light emission scan line Ei, the first initialization scan signal Init[i] of the first initialization scan line GIi is converted into the high voltage Vgh and a scan signal Scan[i] at a low voltage Vgl is applied to the scan line GWi. Then, the switching transistor T3 is turned on and then the driving transistor T1 is diode-connected. Further, the switching transistor T2 is turned on and then the data voltage Vdata from the data line Dj is transferred to the first input and output terminal of the driving transistor T1. In this case, when a threshold voltage of the diode-connected driving transistor T1 is Vth, a (Vdata-Vth) voltage is applied to the control terminal of the driving transistor T1. Accordingly, a [ELVDD-(Vdata-Vth)] voltage is stored in the capacitor Cst.

Next, the scan signal Scan[i] of the scan line GWi is converted to the high voltage Vgh, and the light emission scan signal Emit[i] of the light emission scan line Ei is converted to the low voltage Vgl. Accordingly, the switching transistors T5 and T6 are turned on and then a current $I_{LD}$ from the driving transistor T1 flows to the OLED LD and the OLED LD emits light with brightness corresponding to the current. In this case, since the current $I_{LD}$ from the driving transistor T1 is determined like Equation 1, the current $I_{LD}$ is not influenced by a deviation of the threshold voltage of the driving transistor T1.

$$I_{LD}=\beta/2(Vgs-Vth)^2=\beta/2((ELVDD-(Vdata-Vth)-Vth))^2=\beta/2(ELVDD-Vdata)^2 \quad \text{[Equation 1]}$$

Here, Vgs is a gate-source voltage difference of the driving transistor T1, and β is a parameter determined according to a characteristic of the driving transistor T1.

In any exemplary embodiment, the first initialization scan line GIi is not connected to the control terminals of the switching transistors T4 and T7 of the pixel PX, but a previous scan line [S(i−1)] can be connected. Then, the switching transistors T4 and T7 can be turned on in response to a low voltage of the scan signal Scan[i−1] of the previous scan line [S(i−1)] which is applied before the scan signal Scan[i] of the scan line GWi. In another exemplary embodiment, different signal lines are also connected to the control terminal of the switching transistor T4 and the control terminal of the switching transistor T7.

Hereinafter, a defective pixel repair according to the exemplary embodiment will be described.

Figure 4:
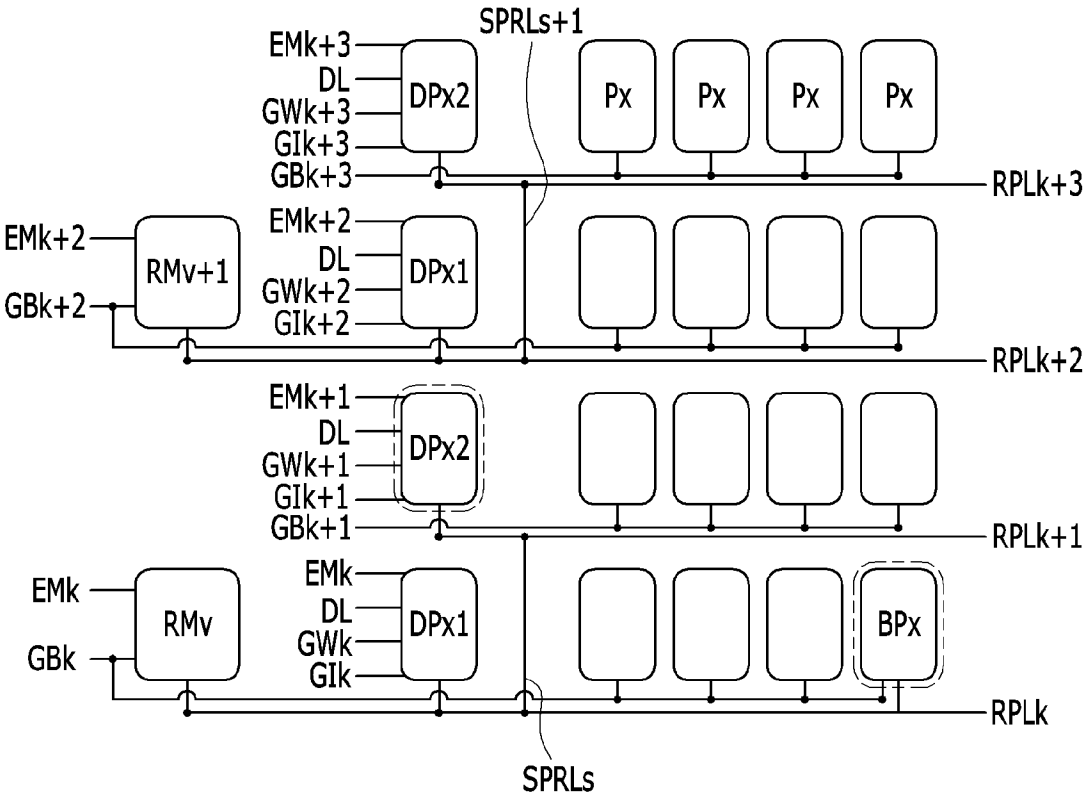
FIG. 4 is a conceptual diagram illustrating a repair procedure for a defective pixel according to the exemplary embodiment.

FIG. 4 is a conceptual diagram illustrating a repair procedure for a defective pixel according to the exemplary embodiment.

Figure 5:
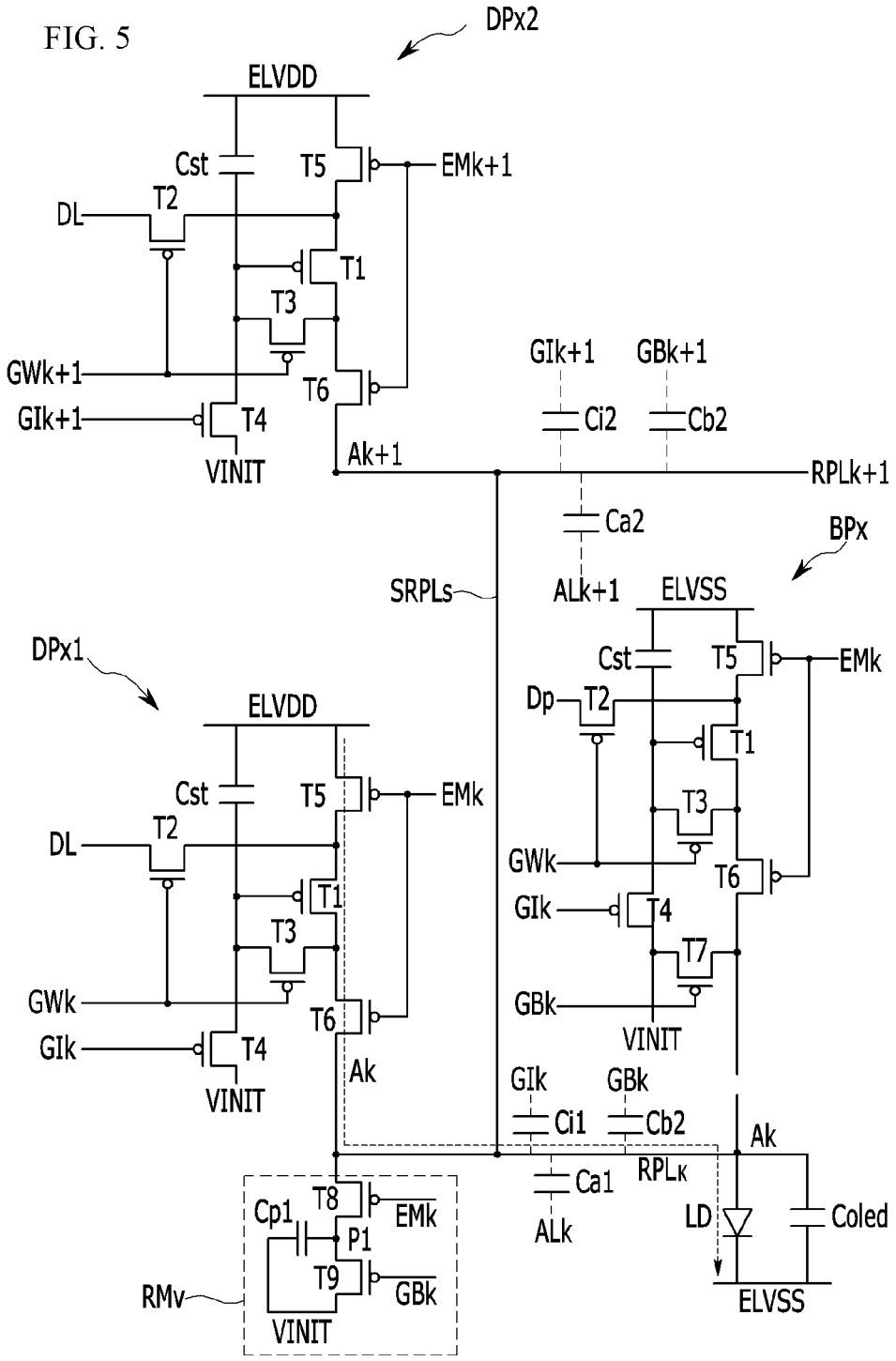
FIG. 5 is a circuit diagram of a defect pixel and dummy pixels of FIG. 4.

FIG. 5 is a circuit diagram of the defect pixel and dummy pixels of FIG. 4.

Figure 6:
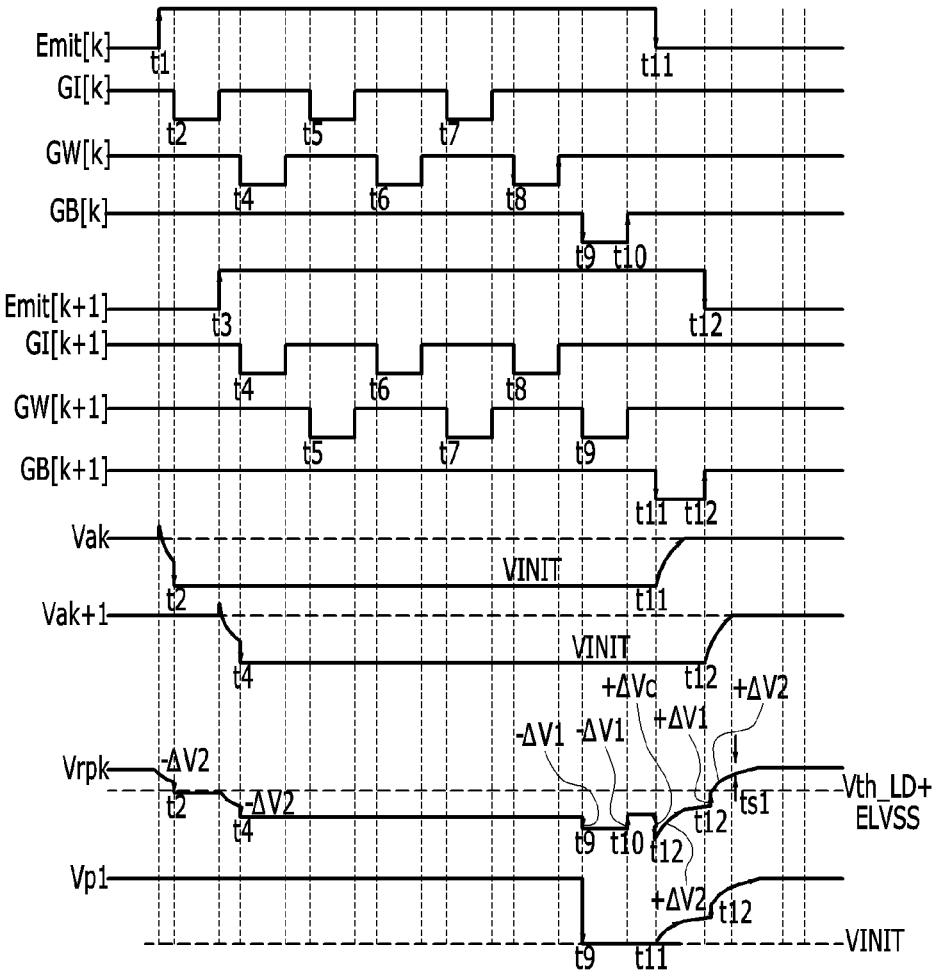
FIG. 6 is a signal timing of the defective pixel and dummy pixels of FIG. 5.

FIG. 6 is a signal timing of the defective pixel and dummy pixels of FIG. 5.

Referring to FIG. 4, a plurality of dummy pixels DPx1 and a plurality of dummy pixels DPx2 are respectively connected to a plurality of corresponding repair lines among a plurality of repair lines RPLk, RPLk+1, RPLk+2, and RLk+3. Each of a plurality of repair modulation circuits RMv and RMv+1 is connected to each of the dummy pixels DPx2.

Each of the plurality of dummy pixels DPx1 and the plurality of dummy pixels DPx2 is connected to each of a plurality of sub repair lines SRPLs and SRPLs+1. Further, the dummy pixel DPx2 connected to the repair line RPLk and the dummy pixel DPx1 connected to the repair line RPLk+1 share the repair modulation circuit RMv. The dummy pixel DPx2 connected to the repair line RPLk+2 and the dummy pixel DPx1 connected to the repair line RPLk+3 share the repair modulation circuit RMv+2.

The pixels PX and a defective pixel BPX are respectively connected to second corresponding initialization lines among a plurality of second initialization lines GBk, GBk+1, GBk+2, and GBk+3.

The dummy pixel DPx1 according to the exemplary embodiment can be a pixel circuit driving a red or blue OLED LD, and the second dummy pixel DPx2 can be a pixel circuit driving a green OLED LD, but the exemplary embodiment is not limited thereto.

The dummy pixel DPx1 connected to the repair line RPLk is connected to the light emission scan line EMk, the dummy signal line DL, the scan line GWk, and the first initialization scan line GIk.

The repair modulation circuit RMv is connected to the repair line RPLk, the light emission scan line EMk, and the second initialization scan line GBk.

The dummy pixel DPx2 connected to the repair line RPLk+1 is connected to the light emission scan line EMk+1, the dummy signal line DL, the scan line GWk+1, and the initialization scan line GIk+1.

The dummy pixel DPx1 connected to the repair line RPLk+2 is connected to the repair line RPLk+2, the light emission scan line EMk+2, the dummy signal line DL, the scan line GWk+2, and the initialization scan line GIk+2.

The repair modulation circuit RMv+2 is connected to the repair line RPLk+2, the light emission scan line EMk+2, and the second initialization scan line GBk+1.

The dummy pixel DPx2 connected to the repair line RPLk+3 is connected to the light emission scan line EMk+3, the dummy signal line DL, the scan line GWk+3, and the initialization scan line GIk+3.

Hereinafter, a repairing method of the defective pixel BPX by connecting the defective pixel BPX with the dummy pixel DPx2 and using the dummy pixel DPx1, the repair modulation circuit RMv, and the dummy pixel DPx2 will be described with reference to FIG. 5.

Referring to FIG. 5, the dummy pixel DPx1 and the dummy pixel DPx2 include dummy pixel driving circuits.

The dummy pixel driving circuit of the dummy pixel DPx1 includes the driving transistor T1, the capacitor Cst, and the switching transistors T2, T3, T4, T5, and T6.

The dummy pixel driving circuit of the dummy pixel DPx2 includes the driving transistor T1, the capacitor Cst, and the switching transistors T2, T3, T4, T5, and T6.

The repair modulation circuit RMv includes switching transistors (or initialization transistors) T8 and T9 and a capacitor (or initialization capacitor) Cp1.

The driving transistor T1, the capacitor Cst, and the switching transistors T2, T3, T4, T5, and T6 of the dummy pixel driving circuit of the dummy pixel DPx1 and the driving transistor T1, the capacitor Cst, and the switching transistors T2, T3, T4, T5, and T6 of the dummy pixel driving circuit of the dummy pixel DPx2 are connected to each other like the corresponding configuration of the driving transistor T1, the capacitor Cst, and the switching transistors T2, T3, T4, T5, and T6 of the pixel DPx illustrated in FIG. 2.

The control terminal of the switching transistor T2 of the dummy pixel DPx1 is connected to the scan line GWk. The control terminal of the switching transistor T3 is connected to the scan line GWk.

The control terminal of the switching transistor T4 of the dummy pixel DPx1 is connected to the first initialization scan line GIk, and the second input and output terminal of the switching transistor T6 is connected to a node Ak.

The control terminal of the switching transistor T2 of the dummy pixel DPx2 is connected to the scan line GWk+1. The control terminal of the switching transistor T3 is connected to the scan line GWk+1.

The control terminal of the switching transistor T4 of the dummy pixel DPx2 is connected to the first initialization scan line GIk+1, and the second input and output terminal of the switching transistor T6 is connected to a node Ak+1.

The control terminal of the switching transistor T8 is connected to the light emission signal line EMk. The first input and output terminal is connected to a connection node AK of the repair line RPLk and the second input and output terminal of the sixth switching transistor T6. The second input and output terminal is connected to a connection node P1 of the capacitor Cp1 and the switching transistor T9.

The control terminal of the switching transistor T9 is connected to the second initialization scan line GBk, the first input and output terminal is connected to the connection node P1. The second input and output terminal is connected to the initialization voltage line supplying an initialization voltage VINIT One terminal of the capacitor Cp1 is connected to the node P1, and the other terminal is connected to the initialization voltage line supplying the initialization voltage VINIT.

The repair line RPLk is connected to the anode of the OLED LD of the defective pixel BPX, and the node Ak and the node Ak+1 are connected to each other through the sub repair line SRPLs.

Referring to FIG. 5, when a defective is generated in a pixel BPX connected to a k-th scan line GWk and a p-th data line Dp, a line between the anode of the OLED LD of the defective pixel BPX and the switching transistor T6 is disconnected, and the anode of the OLED LD of the defective pixel BPX and the node Ak are connected to each other with the repair line RPLk. In addition, the data signal supplied from the data line Dp is transferred to the dummy signal line DL. Then, the OLED LD of the defective pixel BPX can normally emit light by the current transferred from the driving transistor T1 of the dummy pixel DPx2.

Further, a data signal corresponding to a black gray is applied to the first input and output terminal of the switching transistor T2 of the dummy pixel DPx2 through the dummy signal line DL and thus the current transferred from the transistor T1 is about 0 A.

In this case, a parasitic capacitor Ca1 can be formed by the repair line RPLk and the anode line ALk of normal pixels PX (see FIG. 4) of a k-th line (the same line as the defective pixel BPX). A parasitic capacitor Ci1 can be formed by the repair line RPLk and the first initialization scan line GIk connected to the control terminal of the transistor T4 of the defective pixel BPX. A parasitic capacitor Cb1 can be formed by the repair line RPLk and the second initialization scan line GBk connected to the control terminal of the transistor T9 of the repair modulation circuit RMv.

Further, a parasitic capacitor Ca2 can be formed by the repair line RPLk+1 and the anode line ALk+1 of normal pixels PX (see FIG. 4) of a k+1-th line. A parasitic capacitor Ci2 can be formed by the repair line RPLk+1 and the first initialization scan line GIk connected to the control terminal of the transistor T7 of normal pixels PX (see FIG. 4) of the k+1-th line. A parasitic capacitor Cb2 can be formed by the repair line RPLk and the second initialization scan line GBk+1 connected to the control terminal of the switching transistor T7 of normal pixels PX (see FIG. 4) of the k+1-th line.

Referring to FIG. 6, at a time t1, when the light emission signal Emit[k] is converted from the low voltage Vgl to the high voltage Vgh, the switching transistors T5 and T6 of the defective pixel BPX are turned off. Then, a voltage charged in a parasitic capacitor Coled of the OLED LD of the defective pixel BPX is reduced and thus an anode voltage Vak is reduced. In this case, the anode voltage Vak is a representative anode voltage of the pixels PX (see FIG. 4) positioned in a k-th row.

Further, the switching transistors T5 and T6 of the dummy pixel DPx2 and the switching transistor T8 of the repair modulation circuit RMv are turned off, and as a result, the voltage charged in a parasitic capacitor Coled of the OLED LD of the defective pixel BPX is reduced and thus a voltage Vrpk of the repair line RPLk is reduced.

At a time t2, the first initialization signal GI[k] is converted from the high voltage Vgh to the low voltage Vgl and thus the reduced anode voltage Vak is initialized with the initialization voltage VINIT. Thereafter, until a time t11 when the light emission signal Emit[k] is converted from the high voltage Vgh to the low voltage Vgl, the anode voltage Vak is maintained as the initialization voltage VINIT.

Further, the control terminal voltage of the driving transistor T1 of the dummy pixel DPx1 is initialized with the initialization voltage VINIT. Accordingly, the voltage Vrpk of the repair line RPLk is reduced by the parasitic capacitor Ci1 formed by the first initialization scan line GIk. For example, the voltage Vrpk is reduced by ΔV2 voltage which is a voltage corresponding to approximately ELVSS+Vth_LD.

At a time t3, when the light emission signal Emit[k+1] is converted from the low voltage Vgl to the high voltage Vgh, the switching transistors T5 and T6 of the dummy pixel DPx2 and the switching transistors T5 and T6 of all pixels in the k+1-th row are turned off, and the voltage charged in the parasitic capacitor Coled of the OLED of all pixels in the k+1-th row is reduced. As a result, the anode voltage Vak+1 and the voltage Vrpk+1 of the repair line RPLk+1 are reduced.

At a time t4, the first initialization signal GI[k+1] is converted from the high voltage Vgh to the low voltage Vgl and thus a control terminal voltage of the driving transistor T1 of the dummy pixel DPx2 is initialized with the initialization voltage VINIT. Accordingly, the voltage Vrpk+1 of the repair line RPLk+1 is also reduced by ΔV2 voltage by the parasitic capacitor Ci2 formed by the first initialization scan line GIk+1.

Further, the anode voltage Vak+1 is initialized with the initialization voltage VINIT. Thereafter, until a time t12 when the light emission signal Emit[k+1] is converted from the high voltage Vgh to the low voltage Vgl, the anode voltage Vak+1 is maintained as the initialization voltage VINIT.

In addition, the data signal supplied from the data line Dp is transferred to the dummy signal line DL.

At a time t5, a data signal of a black gray is transferred to the dummy pixel DPx2 through the dummy signal line DL.

At the times t2, t5, and t6, the voltage of the initialization scan signal Gi[k] is repeatedly converted from the low voltage Vgl to the high voltage Vgh, and at the times t4, t6, and t8, the voltage of the scan signal GW[k] is repeatedly converted from the low voltage Vgl to the high voltage Vgh.

At the times t4, t5, and t8, the voltage of the initialization scan signal Gi[k+1] is repeatedly converted from the low voltage Vgl to the high voltage Vgh, and at the times t5, t6, and t7, the voltage of the scan signal Gi[k+1] is repeatedly converted from the low voltage Vgl to the high voltage Vgh.

When a black image or a white image is displayed and driven for a long time, a level of the voltage applied to the driving transistor T1 is continued to prevent a hysteresis phenomenon.

At a time t9, the second initialization signal GB [k] applied to the normal pixel PX (see FIG. 4) in the k-th row is converted from the high voltage Vgh to the low voltage Vgl. When the initialization signal GB [k] is reduced to the low voltage Vgl, the switching transistor t9 of the repair modulation circuit RMv is turned on and the capacitor Cp1 is initialized with the initialization voltage VINIT. In this case, the voltage Vrpk of the repair line RPLk is reduced by ΔV1 voltage by the parasitic capacitor Cb1 formed by the second initialization scan line GBk. Further, the voltage Vp1 of the node P1 is reduced to the initialization voltage VINIT.

At a time t10, the second initialization signal GB [k] is increased to the high voltage Vgh and thus the voltage Vrpk of the repair line RPLk can be increased by ΔV1 voltage by the parasitic capacitor Cb1.

At a time t11, the second initialization signal GB [k+1] applied to the normal pixel PX (see FIG. 4) in the k+1-th row is converted from the high voltage Vgh to the low voltage Vgl. In this case, the voltage Vrpk of the repair line RPLk can be reduced by ΔV1 voltage by the parasitic capacitor Cb2 formed by the second initialization scan line GBk+1.

Further, the light emission signal Emit[k] is converted to the lower voltage. Then, the driving current corresponding to the data signal supplied from the data line Dp to the dummy signal line DL is output from the driving transistor T1 of the dummy pixel DPx2 to the repair line RPLk. A part of the current output from the driving transistor T1 of the dummy pixel DPx2 is used to compensate for the voltage of the capacitor Cp1 initialized with the initialization voltage VINIT. Charges charged in the parasitic capacitors Ci1, Cb1, and Coled move to the capacitor Cp1 by charge sharing of the capacitor Cp1 of the parasitic capacitors Ci1, Cb1, and Coled and thus the voltage Vprk of the repair line RPLk is reduced by ΔVc.

Further, in the defective pixel BPX, the current is supplied to the driving transistor T1 to charge the parasitic capacitor Coled of the OLED LD, and thus the anode voltage Vak of the OLED LD is increased. As a result, the voltage Vrpk of the repair line RPLk can be increased by ΔV2 voltage by the parasitic capacitor Ca1. In this case, the voltage Vp1 of the node P1 is increased according to the voltage Vrpk of the repair line RPLk by the turned-on switching transistor T8.

At a time t12, the second initialization signal GB[k+1] is converted from the low voltage Vgl to the high voltage Vgh. As a result, the voltage Vrpk+1 of the repair line RPLk+1 can be increased by ΔV1 voltage by the parasitic capacitor Cb2.

Further, in the dummy pixel DPx1, the current is supplied through the driving transistor T1 to charge the parasitic capacitor Coled of the OLED LD, and thus the anode voltage Vak+1 of the OLED LD is increased. As a result, the voltage Vrpk+1 of the repair line RPLk+1 can be increased by ΔV2 voltage by the parasitic capacitor Ca2. In this case, the voltage Vp1 of the node P1 is increased according to the voltage Vrpk of the repair line RPLk by the turned-on switching transistor T8. Since the second initialization signal GB[k+1] is reduced to the low voltage Vgl, the voltage Vrpk+1 of the repair line RPLk+1 can be reduced by ΔV1 voltage by the parasitic capacitor Cb2 formed by the second initialization scan line GBk+1.

Further, the light emission signal Emit[k+1] is converted to the lower voltage. As a result, the current is supplied through the driving transistor T1 of a dummy pixel DPx_c and thus the anode voltage Vak+1 is increased. As a result, the voltage Vrpk of the repair line RPLk can be increased by ΔV2 voltage by the parasitic capacitor Ca2. In this case, the voltage Vp1 of a node P2 is increased according to the voltage Vrpk of the repair line RPLk.

Meanwhile, after a time ts1 when the charge sharing is completed, the parasitic capacitor Coled of the OLED LD of the defective pixel BPX and the parasitic capacitor Ca1 of the repair line RPLk are charged by a part of the current output from the driving transistor T1 of the dummy pixel, and thus the voltage Vrpk of the repair line RPLk is increased by the voltage corresponding to the low gray.

As such, according to the exemplary embodiment described with reference to FIGS. 4 to 8, a part of the current output from the driving transistor T1 is used to compensate for the voltage reduced by the charge sharing of the capacitor Cp1 and the parasitic capacitors Ci1, Cb1, and Coled, an effect due to a boosting caused by the parasitic capacitors Ci1, Cb1, and Coled can be reduced.

Further, a potential of the node P1 can be the same as a potential Vrpk of the repair line RPLk.

Hereinafter, a repairing method of a defective pixel according to another exemplary embodiment will be described with reference to FIG. 7.

Figure 7:
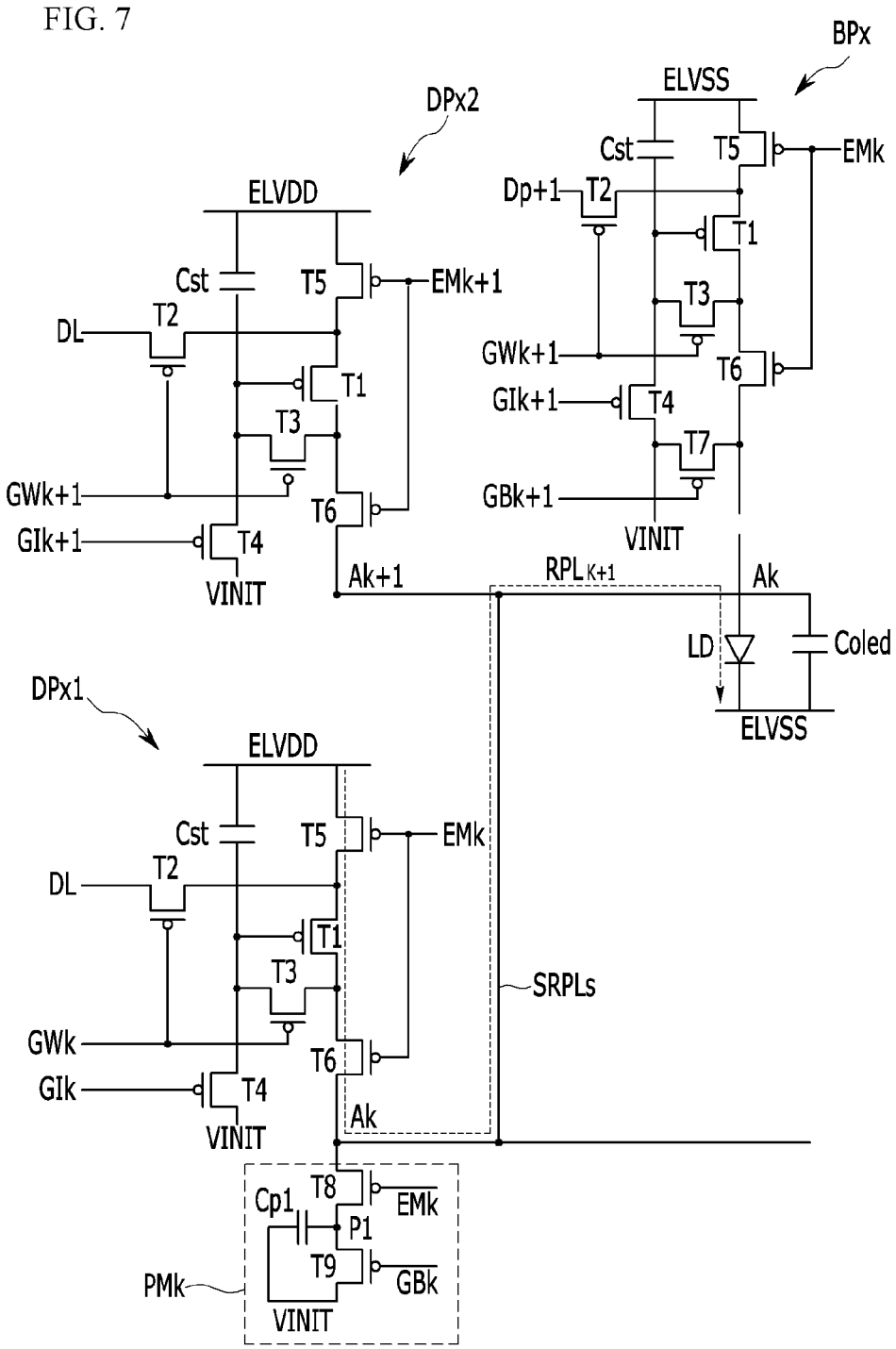
FIG. 7 is a circuit diagram of a repair procedure for a defective pixel according to another exemplary embodiment.

FIG. 7 is a circuit diagram of a repair procedure for a defective pixel according to another exemplary embodiment.

The same configuration as the repairing method of the defective pixel according to the exemplary embodiment of FIGS. 5 and 6 designates the same reference numeral and description of the same configuration is omitted.

Referring to FIG. 7, for example, when a defective is generated in a pixel BPX connected to a scan line GWk+1 and a data line Dp+1, a line between the anode of the OLED LD of the defective pixel BPX and the switching transistor T6 is disconnected, and the anode of the OLED LD of the defective pixel BPX and the node Ak are connected to each other through the repair line RPLk+1. In addition, the data signal supplied from the data line Dp+1 is transferred to the dummy signal line DL. Then, the OLED LD of the defective pixel BPX can normally emit light by the current transferred from the driving transistor T1 of the dummy pixel DPx1.

Further, a data signal corresponding to a black gray is applied to the first input and output terminal of the switching transistor T2 of the dummy pixel DPx2 through the dummy signal line DL and thus the current transferred from the transistor T1 of the dummy pixel DPx2 is about 0 A.

Since the repairing method of the defective pixel BPX by connecting the defective pixel BPX with the dummy pixel DPx1 and using the dummy pixel DPx1, the repair modulation circuit RMv, and the dummy pixel DPx2 is the same as that of the exemplary embodiment described with reference to FIGS. 5 and 6 described above, the method is omitted.

Hereinafter, a repairing method of a defective pixel according to yet another exemplary embodiment will be described with reference to FIG. 8.

Figure 8:
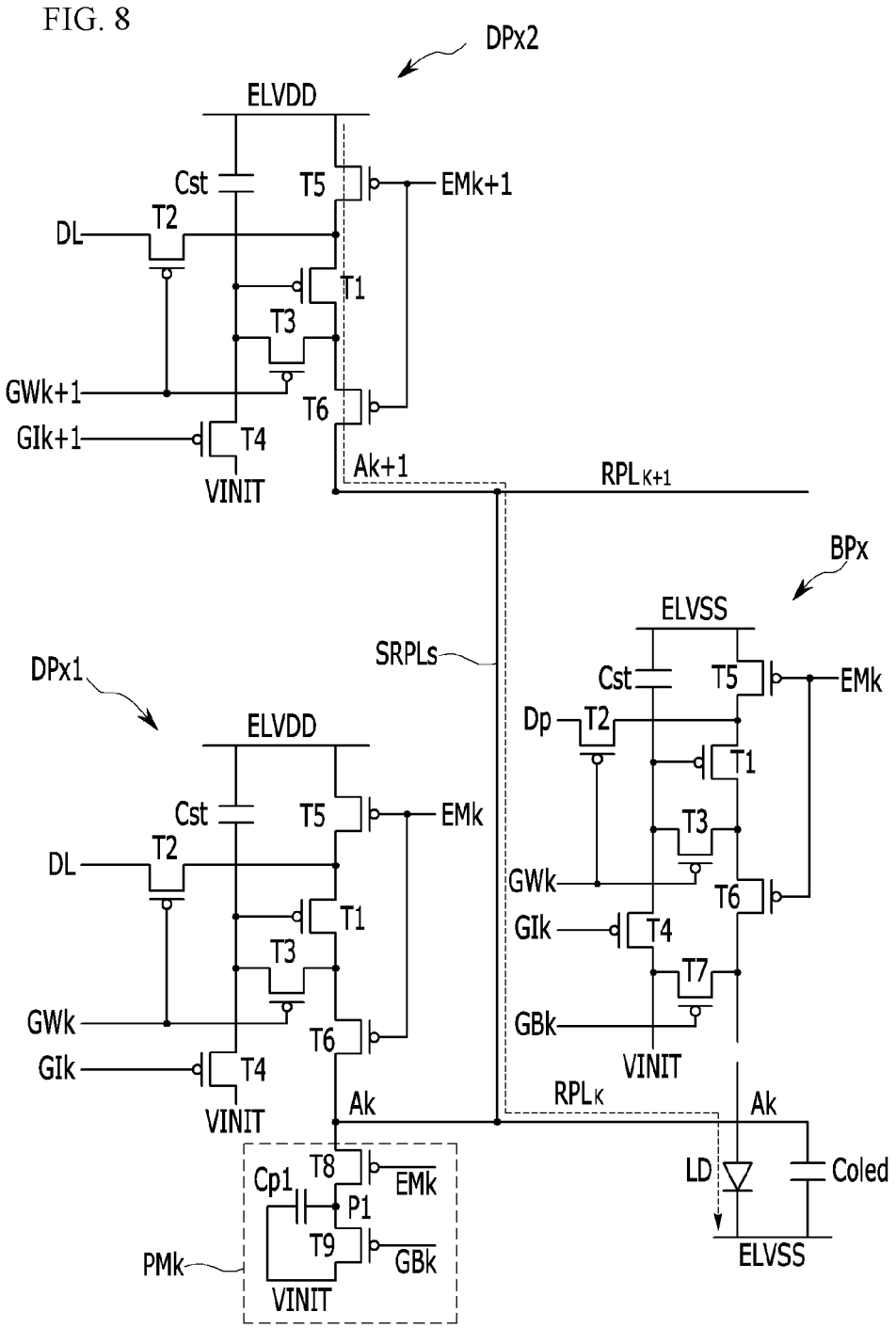
FIG. 8 is a circuit diagram of a repair procedure for a defective pixel according to yet another exemplary embodiment.

FIG. 8 is a circuit diagram of a repair procedure for a defective pixel according to yet another exemplary embodiment.

The same configuration as the repairing method of the defective pixel according to the exemplary embodiment of FIGS. 5 and 6 designates the same reference numeral and description of the same configuration is omitted.

Referring to FIG. 8, for example, when a defective is generated in a pixel BPX connected to a scan line GWk and a data line Dp, a line between the anode of the OLED LD of the defective pixel BPX and the switching transistor T6 is disconnected, and the anode of the OLED LD of the defective pixel BPX and the node Ak are connected to each other through the repair line RPLk. In addition, the data signal supplied from the data line Dp is transferred to the dummy signal line DL. Then, the OLED LD of the defective pixel BPX can normally emit light by the current transferred from the driving transistor T1 of the dummy pixel DPx1.

Further, a data signal corresponding to a black gray is applied to the first input and output terminal of the switching transistor T2 of the dummy pixel DPx1 through the dummy signal line DL and thus the current transferred from the transistor T1 of the dummy pixel DPx1 is about 0 A.

Since the repairing method of the defective pixel BPX by connecting the defective pixel BPX with the dummy pixel DPx1 and using the dummy pixel DPx1, the repair modulation circuit RMv, and the dummy pixel DPx2 is the same as that of the exemplary embodiment described with reference to FIGS. 5 and 6 described above, the method is omitted.

Hereinafter, a repairing method of a defective pixel according to another exemplary embodiment will be described.

Figure 9:
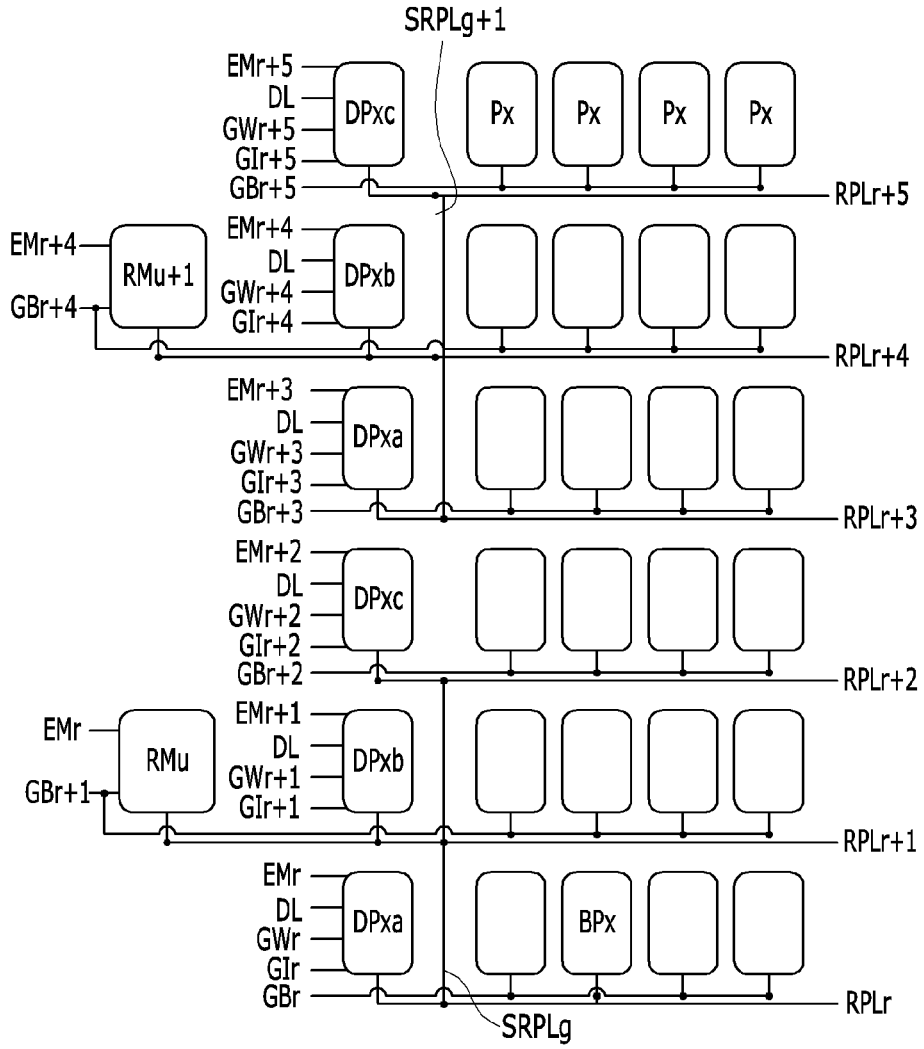
FIG. 9 is a block diagram illustrating a repair procedure for a defective pixel according to another exemplary embodiment.

FIG. 9 is a block diagram illustrating a repair procedure according to another exemplary embodiment.

Figure 10:
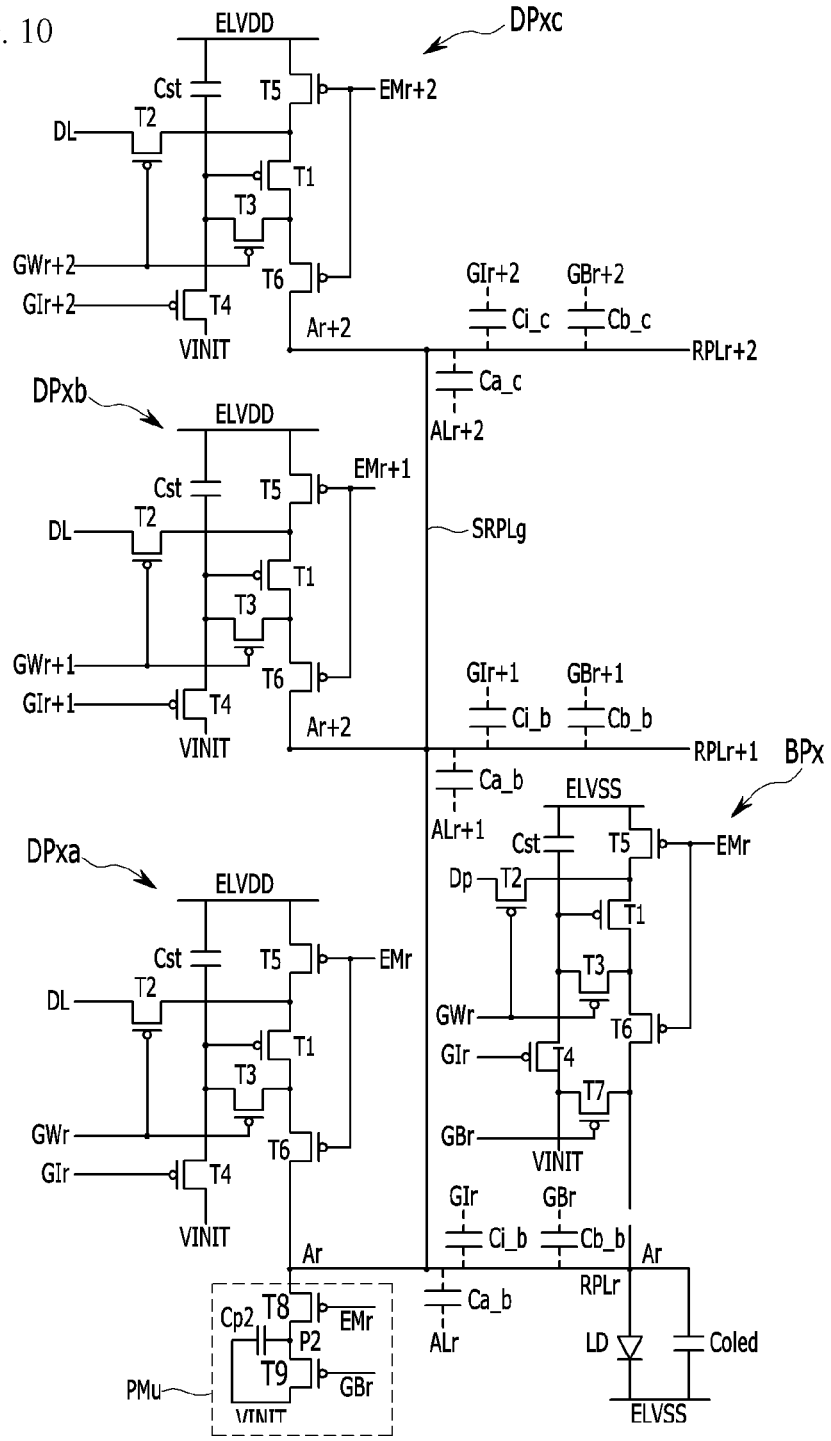
FIG. 10 is a circuit diagram of the defective pixel and dummy pixels of FIG. 9.

FIG. 10 is a circuit diagram of the defective pixel and dummy pixels of FIG. 9.

Figure 11:
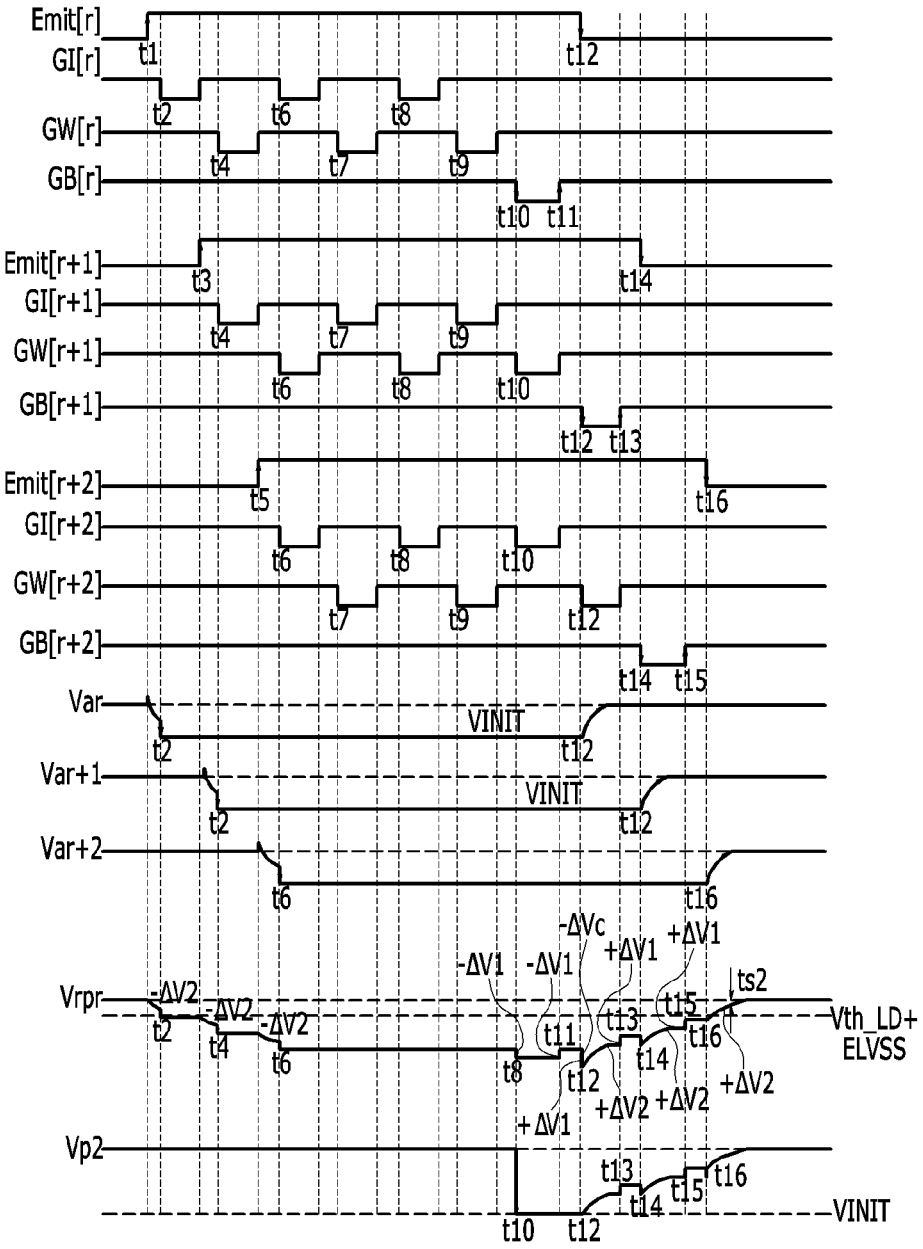
FIG. 11 is a signal timing of the defective pixel and dummy pixels of FIG. 10.

FIG. 11 is a signal timing of the defective pixel and dummy pixels of FIG. 10.

Referring to FIG. 9, a dummy pixel DPxa, a dummy pixel DPxb, and a dummy pixel DPxc are connected to a plurality of corresponding repair lines among a plurality of repair lines RPLr, RPLr+1, RPLr+2, RLr+3, RLr+4, and RLr+5, respectively. Each of a plurality of repair modulation circuits RMu and RMu+1 is connected to each of the plurality of dummy pixels DPxb.

Each of the dummy pixels DPxa, the dummy pixels DPxb, and the dummy pixels DPxc is connected to each of a plurality of sub repair lines SRPLg and SRPLg+1. Further, the dummy pixel DPxa connected to the repair line RPLr, the dummy pixel DPxb connected to the repair line RPLr+1, and the dummy pixel DPxc connected to the repair line RPLr+2 share the repair modulation circuit RMu. The dummy pixel DPxa connected to the repair line RPLr+3, the dummy pixel DPxb connected to the repair line RPLk+4, and the dummy pixel DPxc connected to the repair line RPLk+5 share the repair modulation circuit RMv+4.

The pixels PX and a defective pixel BPX are connected to second corresponding initialization lines among a plurality of second initialization lines GBr, GBr+1, GBr+2, GBr+3, GBr+4, and GBr+5, respectively.

Each of the dummy pixels DPxa, the dummy pixels DPxb, and the dummy pixels DPxc according to another exemplary embodiment can be a pixel circuit driving a red, blue, or green OLED LD.

The dummy pixel DPxc connected to the repair line RPLr is connected to the light emission scan line EMr, the dummy signal line DL, the scan line GWr, and the first initialization scan line GIr.

The repair modulation circuit RMu is connected to the repair line RPLr, the light emission scan line EMr, and the second initialization scan line GBr.

The dummy pixel DPxb connected to the repair line RPLr+1 is connected to the light emission scan line EMr+1, the dummy signal line DL, the scan line GWr+1, and the initialization scan line GIr+1.

The dummy pixel DPxa connected to the repair line RPLk+2 is connected to the repair line the light emission scan line EMk+2, the dummy signal line DL, the scan line GWk+2, and the initialization scan line GIk+2.

The dummy pixel DPxc connected to the repair line RPLr+3 is connected to the light emission scan line EMr+3, the dummy signal line DL, the scan line GWr+3, and the initialization scan line GIr+3.

The repair modulation circuit RMu+1 is connected to the repair line RPLr+4, the light emission scan line EMr+4, and the second initialization scan line GBr+1.

The dummy pixel DPxb connected to the repair line RPLr+4 is connected to the light emission scan line EMr+4, the dummy signal line DL, the scan line GWr+4, and the initialization scan line GIr+4.

The dummy pixel DPxa connected to the repair line RPLr+5 is connected to the repair line RPLr+5, the light emission scan line EMr+5, the dummy signal line DL, the scan line GWr+5, and the initialization scan line GIr+5.

Hereinafter, a repairing method of the defective pixel BPX by connecting the defective pixel BPX with the dummy pixel DPxb and using the dummy pixel DPxa, the repair modulation circuit RMu, the dummy pixel DPxb, and the dummy pixel DPxc will be described with reference to FIG. 10.

Referring to FIG. 10, the dummy pixel DPxa, the dummy pixel DPxb, and the dummy pixel DPxc include dummy pixel driving circuits.

The dummy pixel driving circuit of the dummy pixel DPxa includes the driving transistor T1, the capacitor Cst, and the switching transistors T2, T3, T4, T5, and T6.

The dummy pixel driving circuit of the dummy pixel DPxb includes the driving transistor T1, the capacitor Cst, and the switching transistors T2, T3, T4, T5, and T6.

The dummy pixel driving circuit of the dummy pixel DPxc includes the driving transistor T1, the capacitor Cst, and the switching transistors T2, T3, T4, T5, and T6.

The repair modulation circuit RMu includes switching transistors T8 and T9 and a capacitor Cp2.

The driving transistors T1, the capacitors Cst, and the switching transistors T2, T3, T4, T5, and T6 of the dummy pixel driving circuits of the dummy pixel DPxa, the dummy pixel DPxb, and the dummy pixel DPxc and the driving transistor T1, the capacitor Cst, and the switching transistors T2, T3, T4, T5, and T6 of the dummy pixel driving circuit of the dummy pixel DPx2 are connected to each other like the corresponding configuration of the driving transistor T1, the capacitor Cst, and the switching transistors T2, T3, T4, T5, and T6 of the dummy pixel DPx1 illustrated in FIG. 5.

Further, the switching transistors T8 and T9 and the capacitor Cp2 of the repair modulation circuit RMu are connected the same as the switching transistors T8 and T9 and the capacitor Cp1 of the repair modulation circuit RMv of FIG. 5.

The control terminal of the switching transistor T4 of the dummy pixel DPxa is connected to the first initialization scan line GIr, and the second input and output terminal of the switching transistor T6 is connected to the node Ar.

The control terminal of the switching transistor T4 of the dummy pixel DPxb is connected to the first initialization scan line GIr+1, and the second input and output terminal of the switching transistor T6 is connected to the node Ar+1.

The control terminal of the switching transistor T4 of the dummy pixel DPxc is connected to the first initialization scan line GIr+2, and the second input and output terminal of the switching transistor T6 is connected to the node Ar+2.

The repair line RPLr is connected to the anode of the OLED LD of the defective pixel BPX, and the node Ar, the node Ar+1, and the node Ar+2 are connected to each other through the sub repair line SRPLg.

Referring to FIG. 10, for example, when a defective is generated in a pixel BPX connected to an r-th scan line GWr and a p-th data line Dp, a line between the anode of the OLED LD of the defective pixel BPX and the switching transistor T6 is disconnected, and the anode of the OLED LD of the defective pixel BPX and the node Ar are connected to each other through the repair line RPLr. In addition, the data signal supplied from the data line Dp is transferred to the dummy signal line DL. Then, the OLED LD of the defective pixel BPX can normally emit light by the current transferred from the driving transistor T1 of the dummy pixel DPx2.

Further, a data signal corresponding to a black gray is applied to the switching transistor T2 of the dummy pixel DPxb and the first input and output terminal of the switching transistor T2 of the dummy pixel DPxc through the dummy signal line DL and thus the current transferred from the driving transistor T1 of the dummy pixel DPxb and the driving transistor T1 of the dummy pixel DPxc is 0.

In this case, a parasitic capacitor Ca_a can be formed by the repair line RPLr and the anode line ALr of normal pixels PX (see FIG. 9) of an r-th line (the same line as the defective pixel BPX). A parasitic capacitor Ci_a can be formed by the repair line RPLr and the first initialization scan line GIr connected to the control terminal of the transistor T4 of the defective pixel BPX. A parasitic capacitor Cb_a can be formed by the repair line RPLr and the second initialization scan line GBr connected to the control terminal of the transistor T9 of the repair modulation circuit RMu.

Further, a parasitic capacitor Ca_b can be formed by the repair line RPLr+1 and the anode line ALr+1 of normal pixels PX (see FIG. 9) of an r+1-th line. A parasitic capacitor Ci_b can be formed by the repair line RPLr+1 and the first initialization scan line GIr+1 connected to the control terminal of the transistor T4 of normal pixels PX (see FIG. 9) of the r+1-th line. A parasitic capacitor Cb_b can be formed by the repair line RPLr+1 and the second initialization scan line GBr+1 connected to the control terminal of the switching transistor T7 of normal pixels PX (see FIG. 4) of the r+1-th line.

Further, a parasitic capacitor Ca_c can be formed by the repair line RPLr+2 and the anode line ALr+2 of normal pixels PX (see FIG. 9) of an r+2-th line. A parasitic capacitor Ci_c can be formed by the repair line RPLk+2 and the first initialization scan line GIr+2 connected to the control terminal of the transistor T4 of normal pixels PX (see FIG. 9) of the r+2-th line. A parasitic capacitor Cb_c can be formed by the repair line RPLr+2 and the second initialization scan line GBr+2 connected to the control terminal of the switching transistor T7 of normal pixels PX (see FIG. 4) of the r+2-th line.

Referring to FIG. 11, at a time t1, when the light emission signal Emit[r] is converted from the low voltage Vgl to the high voltage Vgh, the switching transistors T5 and T6 of the defective pixel BPX are turned off. Then, a voltage charged in a parasitic capacitor Coled of the OLED LD of the defective pixel BPX is reduced and thus an anode voltage Vak is reduced. In this case, the anode voltage Var is a representative anode voltage of the plurality of pixels PX (see FIG. 4) positioned in an r-th row.

Further, the switching transistors T5 and T6 of the dummy pixel DPxa and the switching transistor T8 of the repair modulation circuit RMu are turned off, and as a result, the voltage charged in a parasitic capacitor Coled of the OLED LD of the defective pixel BPX is reduced and thus a voltage Vrpr of the repair line RPLr is reduced.

At a time t2, the first initialization signal GI[r] is converted from the high voltage Vgh to the low voltage Vgl and thus a control terminal voltage of the driving transistor T1 of the dummy pixel DPxa is initialized with an initialization voltage VINIT. Accordingly, the voltage Vrpr of the repair line RPLr is reduced by the parasitic capacitor Ci_a formed by the first initialization scan line GIr. For example, the voltage Vrpk is reduced by ΔV2 voltage to be reduced up to a voltage corresponding to approximately ELVSS+Vth_LD.

Further, the anode voltage Var is initialized with the initialization voltage VINIT. Thereafter, until a time t12 when the light emission signal Emit[r] is converted from the high voltage Vgh to the low voltage Vgl, the anode voltage Vak is maintained as the initialization voltage VINIT.

At a time t3, when the light emission signal Emit[r+1] is converted from the low voltage Vgl to the high voltage Vgh, the switching transistors T5 and T6 of the dummy pixel DPxb and the switching transistors T5 and T6 of all the pixels in the r+1-th row are turned off, and the voltage charged in the parasitic capacitor Coled of the OLED of all the pixels in the r+1-th row is reduced. As a result, the anode voltage Var+1 and the voltage Vrpr+1 of the repair line RPLr+1 are reduced.

At a time t4, the first initialization signal GI[r+1] is converted from the high voltage Vgh to the low voltage Vgl and thus a control terminal voltage of the driving transistor T1 of the dummy pixel DPxb is initialized with the initialization voltage VINIT. Accordingly, the voltage Vrp of the repair line RPL is also reduced by ΔV2 voltage by the parasitic capacitor Ci_b formed by the first initialization scan line GIr+1.

Further, the anode voltage Var+1 is initialized to the initialization voltage VINIT. Thereafter, until a time t14 when the light emission signal Emit[r+1] is converted from the high voltage Vgh to the low voltage Vgl, the anode voltage Var+1 is maintained as the initialization voltage VINIT.

In addition, the data signal supplied from the data line Dp is transferred to the dummy signal line DL.

At a time t5, when the light emission signal Emit[r+2] is converted from the low voltage Vgl to the high voltage Vgh, the switching transistors T5 and T6 of the dummy pixel DPxc and the switching transistors T5 and T6 of all pixels in the r+2-th row are turned off, and the voltage charged in the parasitic capacitor Coled of the OLED of all pixels in the r+2-th row is reduced. As a result, the anode voltage Var+2 and the voltage Vrpr+2 of the repair line RPLr+2 are reduced.

At a time t6, the first initialization signal GI[r+2] is converted from the high voltage Vgh to the low voltage Vgl and thus a control terminal voltage of the driving transistor T1 of the dummy pixel DPxc is initialized with the initialization voltage VINIT. Accordingly, the voltage Vrpr of the repair line RPLr is also reduced by ΔV2 voltage by the parasitic capacitor Ci_c formed by the first initialization scan line GIr+2.

Further, the anode voltage Var+2 is initialized with the initialization voltage VINIT. Thereafter, until a time t16 when the light emission signal Emit[r+2] is converted from the high voltage Vgh to the low voltage Vgl, the anode voltage Var+1 is maintained as the initialization voltage VINIT.

Further, a data signal of a black gray is transferred to the dummy pixel DPxb through the dummy signal line DL.

At a time t7, a data signal of a black gray is transferred to the dummy pixel DPxc through the dummy signal line DL.

At the times t2, t6, and t8, the voltage of the initialization scan signal Gi[r] is repeatedly converted from the low voltage Vgl to the high voltage Vgh, and at the times t4, t7, and t9, the voltage of the scan signal GW[r] is repeatedly converted from the low voltage Vgl to the high voltage Vgh.

At the times t4, t7, and t9, the voltage of the initialization scan signal Gi[r+1] is repeatedly converted from the low voltage Vgl to the high voltage Vgh, and at the times t6, t8, and t10, the voltage of the scan signal GW[r+1] is repeatedly converted from the low voltage Vgl to the high voltage Vgh.

At the times t6, t8, and t10, the voltage of the initialization scan signal Gi[r+1] is repeatedly converted from the low voltage Vgl to the high voltage Vgh, and at the times t7, t9, and t12, the voltage of the scan signal GW[r+1] is repeatedly converted from the low voltage Vgl to the high voltage Vgh.

When a black image or a white image is displayed and driven for a long time, a level of the voltage applied to the driving transistor T1 is continued to prevent a hysteresis phenomenon.

At a time t10, the second initialization signal GB [r] applied to the normal pixel PX (see FIG. 9) in the r-th row is converted from the high voltage Vgh to the low voltage Vgl. When the initialization signal GB[r] is reduced to the low voltage Vgl, the switching transistor T9 of the repair modulation circuit RMu is turned on and the capacitor Cp2 is initialized with the initialization voltage VINIT. In this case, the voltage Vrpr of the repair line RPLr can be reduced by ΔV1 voltage by the parasitic capacitor Cb_a formed by the second initialization scan line GBr. Further, the voltage Vp2 of the node P2 is reduced to the initialization voltage VINIT.

At a time t11, the second initialization signal GB[r] is increased to the high voltage Vgh and thus the voltage Vrpr of the repair line RPLr can be increased by ΔV1 voltage by the parasitic capacitor Cb_a.

At a time t12, the second initialization signal GB[r+1] applied to the normal pixel PX (see FIG. 9) in the r+1-th row is converted from the high voltage Vgh to the low voltage Vgl. In this case, the voltage Vrpr of the repair line RPLr can be reduced by ΔV1 voltage by the parasitic capacitor Cb_b formed by the second initialization scan line GBr+1.

Further, the light emission signal Emit[r] is converted to the lower voltage. Then, the driving current corresponding to the data signal supplied from the data line Dp to the dummy signal line DL is output from the driving transistor T1 of the dummy pixel DPxa to the repair line RPLr. A part of the current output from the driving transistor T1 of the dummy pixel DPxa is used to compensate for the voltage of the capacitor Cp2 initialized with the initialization voltage VINIT. Charges charged in the parasitic capacitors Ci_a, Cb_a, and Coled move to the capacitor Cp2 by charge sharing of the parasitic capacitors Ci_a, Cb_a, and Coled and the capacitor Cp2 and thus the voltage Vprk of the repair line RPLk is reduced by ΔVc.

Further, even in the defective pixel BPX, the current is supplied to the driving transistor T1 to charge the parasitic capacitor Coled of the OLED LD, and thus the anode voltage Vak of the OLED LD is increased. As a result, the voltage Vrpk of the repair line RPLk can be increased by ΔV2 voltage by the parasitic capacitor Ca_a. In this case, the voltage Vp2 of the node P2 is increased according to the voltage Vrpr of the repair line RPLr by the turned-on switching transistor T8.

At a time t13, the second initialization signal GB[r+1] is increased to the high voltage Vgh and thus the voltage Vrpr of the repair line RPLr can be increased by ΔV1 voltage by the parasitic capacitor Cb_b.

At a time t14, the second initialization signal GB[r+2] applied to the normal pixel PX (see FIG. 9) in the R+2-th row is converted from the high voltage Vgh to the low voltage Vgl. In this case, the voltage Vrpr of the repair line RPLr can be reduced by ΔV1 voltage by the parasitic capacitor Cb_c formed by the second initialization scan line GBr+2.

Further, the light emission signal Emit[r+1] is converted to the lower voltage. As a result, the current is supplied through the driving transistor T1 of a dummy pixel DPx_b and thus the anode voltage Var+1 is increased. As a result, the voltage Vrpr of the repair line RPLr can be increased by ΔV2 voltage by the parasitic capacitor Ca_b. In this case, the voltage Vp2 of a node P2 is increased according to the voltage Vrpk of the repair line RPLk.

At a time t15, the second initialization signal GB[r+2] is increased to the high voltage Vgh and thus the voltage Vrpr of the repair line RPLr can be increased by ΔV1 voltage by the parasitic capacitor Cb_c.

At a time t16, the light emission signal Emit[r+2] is converted to the lower voltage. As a result, the current is supplied through the driving transistor T1 of a dummy pixel DPx_c and thus the anode voltage Var+2 is increased. As a result, the voltage Vrpr+2 of the repair line RPLr+2 can be increased by ΔV2 voltage by the parasitic capacitor Ca_c. In this case, the voltage Vp2 of a node P2 is increased according to the voltage Vrpr of the repair line RPLr.

Meanwhile, after a time t2*s* when the charge sharing is completed, the parasitic capacitor Coled of the OLED LD of the defective pixel BPX and the parasitic capacitors Ca_a, Ca_b, and Ca_c of the repair line RPLr are charged by a part of the current output from the driving transistor T1 of the dummy pixel DPx2, and thus the voltage Vrpr of the repair line RPLr is increased by the voltage corresponding to the low gray.

As such, according to the exemplary embodiment described with reference to FIGS. 9 to 11, a part of the current output from the driving transistor T1 is used to compensate for the voltage reduced by the charge sharing of the capacitor Cp2 and the parasitic capacitors Ci1, Cb1, and Coled, an effect by boosting due to the parasitic capacitors Ci1, Cb1, and Coled can be offset.

Further, a potential of the node P2 can be the same as a potential Vrpk of the repair line RPLk.

While the inventive technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

an organic light-emitting diode (OLED);

a repair line electrically connected to a first dummy pixel and a second dummy pixel; and a repair modulation circuit electrically connected to the first and second dummy pixels, wherein the first dummy pixel includes a first dummy pixel driving circuit configured to output a driving current corresponding to a data voltage of a selected pixel of the OLED to the repair line, when the selected pixel becomes defective, based on a first light emission control signal, wherein the repair modulation circuit includes a capacitor configured to be initialized before the driving current is output from the first dummy pixel driving circuit, wherein the capacitor of the repair modulation circuit is configured to be charged with the driving current when the driving current is output from the first dummy pixel driving circuit, wherein the capacitor is further configured to share the charged current with a parasitic capacitance of the repair line, and wherein the first dummy pixel, the second dummy pixel, and the repair modulation circuit are electrically connected to a sub repair line, and wherein the first and second dummy pixels share the repair modulation circuit via the sub repair line.

2. The display device of claim 1, wherein the second dummy pixel includes a second dummy pixel driving circuit configured to apply a driving current corresponding to a first data voltage to the repair line based on a second light emission control signal, and wherein the first data voltage includes a black gray data voltage.

3. The display device of claim 2, wherein the repair modulation circuit further includes a transistor electrically connected between the capacitor and the repair line and configured to be turned on or off based on the first light emission control signal.

4. The display device of claim 3, wherein the repair modulation circuit further includes an initialization transistor electrically connected between the capacitor and a voltage line configured to provide an initialization voltage, and wherein the initialization transistor is configured to be turned on or off based on a first initialization signal.

5. The display device of claim 4, wherein a voltage level of the first initialization signal is configured to be changed from a first level to a second level to turn on the initialization transistor before the driving current is output to the repair line.

6. The display device of claim 5, wherein the first dummy pixel driving circuit is configured to provide the driving current to the repair line after the initialization transistor is turned on.

7. The display device of claim 6, further comprising a third dummy pixel electrically connected to the repair line and including a third dummy pixel driving circuit configured to apply a driving current corresponding to a second data voltage to the repair line based on a third light emission control signal, and wherein the second data voltage includes a black gray data voltage.

8. A method of repairing a display device including a repair line electrically connected to a first dummy pixel and a second dummy pixel, and a repair modulation circuit electrically connected to the first and second dummy pixels, the method comprising:

electrically connecting the repair line to an organic light-emitting diode (OLED) of a defective pixel in the display device, wherein the first dummy pixel includes a first dummy pixel driving circuit, and wherein the repair modulation circuit includes a capacitor;

initializing the capacitor;

providing a driving current corresponding to a data voltage of the defective pixel to the repair line in the first dummy pixel;

charging the capacitor with the driving current when the driving current is output from the first dummy pixel driving circuit;

sharing the charged current of the capacitor with a parasitic capacitance of the charged capacitor and the repair line;

electrically connecting the first dummy pixel, the second dummy pixel, and the repair modulation circuit to a sub repair line; and sharing the repair modulation circuit between the first and second dummy pixels.

9. The method of claim 8, wherein the second dummy pixel includes a second dummy pixel driving circuit, wherein the method further comprises applying a driving current corresponding to a first data voltage to the repair line based on a second light emission control signal, and wherein the first data voltage includes a black gray data voltage.

10. The method of claim 9, wherein the repair modulation circuit further includes a transistor electrically connected between the capacitor and the repair line and configured to be turned on or off based on the first light emission control signal.

11. The method of claim 10, wherein the repair modulation circuit further includes an initialization transistor electrically connected between the capacitor and a voltage line configured to provide an initialization voltage, and wherein the initialization transistor is configured to be turned on or off based on a first initialization signal.

12. The method of claim 11, wherein the initializing of the capacitor includes changing the voltage of the first initialization signal from a first level to a second level so as to turn on the initialization transistor.

13. The method of claim 12, wherein the providing of the driving current to the repair line includes providing the driving current to the repair line via the first dummy pixel driving circuit before the initialization transistor is turned on.

14. The method of claim 13, wherein the display device further includes a third dummy pixel electrically connected to the repair line and including a third dummy pixel driving circuit, wherein the method further comprises applying a driving current corresponding to a second data voltage to the repair line based on a third light emission control signal, and wherein the second data voltage includes a black gray data voltage.

15. A display device, comprising:

a display panel including a display area and a non-display area surrounding the display area;

a plurality of display pixels formed in the display area and each including an organic light-emitting diode;

a plurality of dummy pixels formed in the non-display area and including a first dummy pixel and a second dummy pixel; and a repair modulation circuit electrically connected to the first and second dummy pixels and a selected display pixel, wherein the first dummy pixel includes a first dummy pixel driving circuit configured to provide a driving current corresponding to a data voltage of the selected display pixel to the repair line, when the selected display pixel becomes defective, based on a first light emission control signal, wherein the repair modulation circuit includes an initialization capacitor configured to be initialized before the driving current is provided from the first dummy pixel driving circuit, wherein the initialization capacitor of the repair modulation circuit is configured to be charged with the driving current when the driving current is provided from the first dummy pixel driving circuit, wherein the initialization capacitor is further configured to share the charged current with a parasitic capacitance of the repair line when the selected display pixel is defective, and wherein the first dummy pixel, the second dummy pixel, and the repair modulation circuit are electrically connected to a sub repair line, and wherein the first and second dummy pixels share the repair modulation circuit via the sub repair line.

16. The display device of claim 15, wherein the parasitic capacitance includes a first parasitic capacitor formed between the repair line and an anode electrode of the OLED of the selected pixel.

17. The display device of claim 16, wherein the parasitic capacitance further includes a second parasitic capacitor formed between the repair line and a first initialization scan line connected to the selected pixel.

18. The display device of claim 17, wherein the parasitic capacitance further includes a third parasitic capacitor formed between the repair line and a second initialization scan line connected to the repair modulation circuit.

19. The display device of claim 18, further comprising a driving transistor configured to output a current, wherein the current is configured to compensate for a voltage lost by the charge-shared initialization and first to third capacitors.

* * * * *